US007168131B2

(12) United States Patent
Ruggiero

(10) Patent No.: US 7,168,131 B2
(45) Date of Patent: Jan. 30, 2007

(54) CURTAIN CORNER SUPPORTS

(76) Inventor: Anthony J. Ruggiero, 7724 Summerdale Ave., Philadelphia, PA (US) 19111

( * ) Notice: Subject to any disclaimer, the term of this patent is extended or adjusted under 35 U.S.C. 154(b) by 455 days.

(21) Appl. No.: 10/829,785

(22) Filed: Apr. 22, 2004

(65) Prior Publication Data

US 2005/0236115 A1 Oct. 27, 2005

(51) Int. Cl.
*E05D 15/00* (2006.01)

(52) U.S. Cl. ..... 16/87.2; 160/330; 4/558

(58) Field of Classification Search ..... 160/330, 160/349.1, 349.2, 352, DIG. 6; 4/558, 608, 4/610; 16/87 R, 87.2, 89
See application file for complete search history.

(56) References Cited

U.S. PATENT DOCUMENTS

| | | | |
|---|---|---|---|
| 2,219,075 | A | 10/1940 | Le Veau |
| 2,474,552 | A | 6/1949 | Steinmeyer |
| 2,481,397 | A | 9/1949 | Dalton |
| 2,497,824 | A | 2/1950 | Reed |
| 2,538,755 | A | 1/1951 | Bradley |
| 2,545,648 | A | 3/1951 | Byrne |
| 2,554,106 | A | 5/1951 | Heubeck |
| 2,573,985 | A | 11/1951 | Porter |
| 2,741,923 | A | 4/1956 | Bradley |
| 2,771,945 | A | 11/1956 | Wittrup |
| 2,778,030 | A | 1/1957 | Goche |
| 2,878,487 | A | 3/1959 | Foote |
| 2,923,013 | A | 2/1960 | Wasserman |
| 3,338,292 | A | 8/1967 | Goodman |
| 3,418,665 | A | 12/1968 | Long |
| 3,497,905 | A | 3/1970 | Pflum |
| 3,639,919 | A | 2/1972 | White |
| 3,766,572 | A | 10/1973 | Wright |
| 3,879,806 | A | 4/1975 | Armstrong |
| 3,891,091 | A | 6/1975 | Anderson |
| 3,895,399 | A | 7/1975 | Giarrante |
| 3,934,636 | A | 1/1976 | Simmons |
| 4,088,174 | A | 5/1978 | Edwards |
| 4,117,557 | A | 10/1978 | McPeak |
| 4,229,842 | A | 10/1980 | Gilmore |
| 4,361,915 | A | 12/1982 | Siewert |
| 4,381,578 | A | 5/1983 | Glejf |
| 4,385,409 | A | 5/1983 | File |

(Continued)

FOREIGN PATENT DOCUMENTS

| | | |
|---|---|---|
| CA | 1272439 | 7/1990 |

(Continued)

*Primary Examiner*—Blair M. Johnson
(74) *Attorney, Agent, or Firm*—Marvin C. Gaer

(57) ABSTRACT

An improved curtain corner support, is disclosed, which is slidably attached to a standard enclosure curtain rod in order to support and extend a curtain inward around the side corner, where the curtain meets the wall, of a shower stall, a booth or a similar enclosure. This apparatus is used to seal the enclosure to provide privacy or to prevent water from escaping from a shower stall. This corner curtain support, suspended from an enclosure curtain rod near a side lateral wall of the enclosure, comprises a counterweighted, cantilevered, right triangular frame, with the hypotenuse edge formed into a concave arc directed into the enclosed region of the frame, from which can be suspended a curtain, forming an approximately right angle corner enclosure barrier about the open side edge of the enclosure, when the corner support, holding the curtain, is pushed against this side wall.

9 Claims, 5 Drawing Sheets

U.S. PATENT DOCUMENTS 4,461,056 A 7/1984 Solinski
4,493,358 A 1/1985 Jacobson
4,667,353 A 5/1987 Zeigler
4,754,504 A 7/1988 Cellini
4,769,862 A 9/1988 Skrzelowski
5,010,942 A 4/1991 Hung
5,022,104 A 6/1991 Miller
5,031,257 A 7/1991 Jeffery
5,170,974 A * 12/1992 Ruggiero ..... 248/251
5,189,759 A 3/1993 Poore
5,216,766 A 6/1993 Lang
D357,173 S 4/1995 Ruggiero
5,402,842 A 4/1995 Ruggiero

FOREIGN PATENT DOCUMENTS

CA 2116438 2/1996
EP 0602162 4/1996

* cited by examiner

CURTAIN CORNER SUPPORTS

BACKGROUND OF THE INVENTION

The present invention is concerned with improved curtain corner supports, to be used in combination with standard enclosure curtain rods, to support and extend curtains around the open side corners of shower stalls, bathtub shower enclosures, booths, fitting rooms, or medical examining enclosures in order to more effectively seal them. Shower curtains, in particular, are extended across the open sides and corners of shower enclosures to prevent shower spray from escaping the enclosure. To be effective, these curtains must be held against the lateral walls of the enclosure to prevent the spray from escaping around the edges. This invention provides an improvement in accomplishing this. Similarly, in the desire to achieve privacy in the other enclosures mentioned, curtains suspended across the open sides of these enclosures are provided. As in the case of shower enclosures, this invention provides an improved solution to the problem of sealing the edges of these enclosures.

To prevent shower water and spray from escaping the area of a bathtub shower enclosure or shower stall, both often referred to below as a "shower stall" or as a "stall" for short, it is a common practice to suspend a shower curtain downward from hooks that are slidably attached about a shower curtain support rod which spans and bounds the outward opening of a stall from above. Shower areas are formed in various geometric configurations, for example, three walls bounding three sides of a rectangular shower stall or bathtub, or the two walls forming a corner shower stall or bathtub.

A shortcoming of many shower curtain arrangements is that the curtain fails to produce a sufficiently tight barrier or seal against escaping water or water spray where the edge of the curtain meets the stall walls. Because of this failure to sufficiently seal the stall, water escapes the stall area wetting the surrounding floor and walls. This escaping water may cause damage or create unsafe slippery or unsanitary conditions. Removing this water by mopping it up or employing other means is inconvenient, time consuming and is not always completely successful. Various devices and attachments have been proposed to solve this problem with varying degrees of success. In many cases these devices and attachments tend to be both elaborate, complicated, expensive and/or hard to install, thus tending to discourage their use. In some instances, in order to employ certain of these devices, the replacement of the standard shower curtain rods is required, adding to the expense and increasing the difficulty of installation.

Similar problems are encountered in attempting to provide sufficient privacy when using curtained booths, fitting rooms and medical examining enclosures, to mention some common examples. The primary challenge in these cases is to keep the curtain in sufficiently close contact with the lateral side walls of these enclosures so as to provide adequate visual privacy.

SUMMARY OF THE INVENTION

To overcome these problems, this invention discloses an inexpensive, curtain corner support which will extend and support a curtain about the side edges of a stall enclosure, "stall" for short, holding this curtain against a lateral wall of the stall, thus effectively sealing the stall and providing visual privacy and/or preventing water from escaping the stall area in the shower stall case. These corner supports can be slidably attached to standard enclosure or shower stall curtain rods by means of circular clips and a cylindrical sleeve.

In particular, this curtain corner support apparatus consists of a rigid, essentially right triangular frame, with the hypotenuse modified to form an arc, concave inward with respect to the interior plane region defined by the sides of the frame. This triangular frame can be slidably suspended from a standard curtain rod, with one leg of the frame parallel to the curtain rod, and a second leg extending inward into the stall, at a right angle to the first leg and parallel to the nearest lateral wall of the stall. Attached to and projecting above this second leg, at its vertex with the first leg, is a cylindrical, clip-on sleeve, which is axially aligned with the curtain rod around which it fits, in order suspend the corner support from this rod. Projecting from the top of this sleeve, is a threaded, cylindrical collar, whose central cylindrical axis is directed outward from the stall, and perpendicular to the curtain rod. Into this collar is screwed the threaded shaft of a weighted cantilever, at variable distances, to act as a counterweight in order to hold the triangular corner support frame horizontal, when it is suspended from the curtain rod and is supporting a curtain. The concave arc hypotenuse edge, of the triangular frame, connects the end of the first leg, distal to the nearest lateral wall, to the inner end of the second leg which is parallel to the near lateral wall of the stall. This hypotenuse edge has clips for holding an end portion of the stall curtain suspended from the frame, in an inward arc, approximately tangent against the near lateral wall of the stall when the corner support is pushed closed against this wall, thus sealing the stall as required. It is expected that two such corner supports will usually be used, one at each end of the curtain rod.

It is, thus, an object of this invention to provide an improved supplementary support means for suspending a shower enclosure curtain or curtain liner from a standard shower curtain rod to prevent water and water spray from escaping around the edges of the curtain.

It is a further object of this invention to provide an improved supplementary support means for suspending an enclosure curtain from a standard enclosure curtain rod to provide a better visual seal for such an enclosure to afford visual privacy to the occupants.

It is a further object of this invention to provide an enclosure curtain support means which, once installed, will provide an enclosure seal which can be used with minimal intervention by the user.

It is a further object of this invention to provide a supplementary enclosure curtain support which is simple, inexpensive, easy to install and compatible with standard enclosure curtain rods, curtains and curtain liners.

It is a further object of this invention to provide a supplementary enclosure curtain support which can be adapted to a variety of enclosure configurations.

These and other objects will be apparent to those skilled in the art.

BRIEF DESCRIPTION OF THE DRAWINGS

The more specific object features and advantages of this invention will be more readily apparent from the following description, wherein reference is made to the accompanying drawings illustrating a preferred embodiment of the invention. The drawings and description presented here refer to the use of the invention in a bathtub shower stall. Its other uses in booths, stalls or examining rooms is similar.

In the drawings.

DETAILED DESCRIPTION OF THE DRAWINGS

Figure 1:
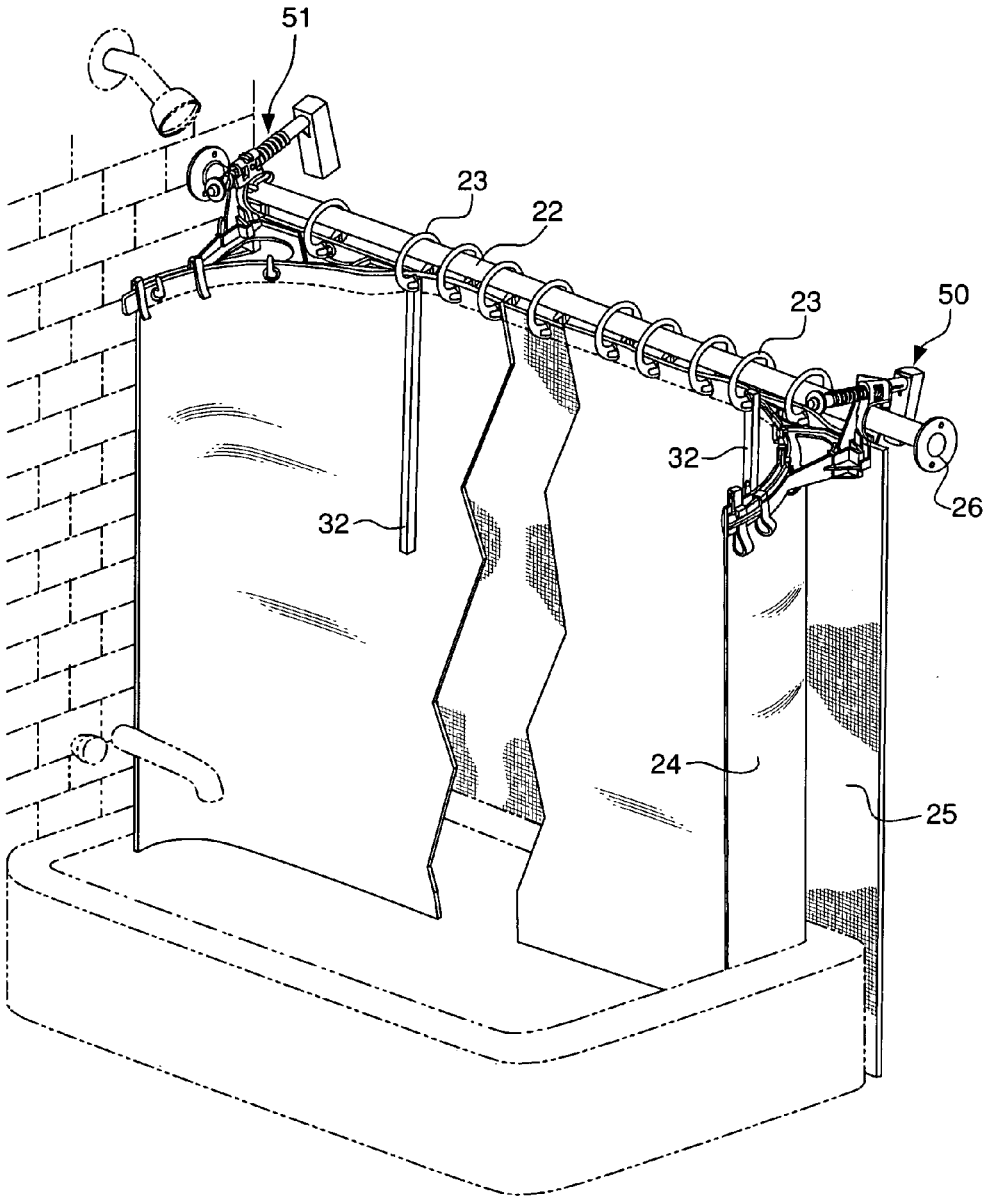
FIG. 1 is a perspective view from inside a bathtub shower enclosure showing two shower curtain corner supports which are supporting an inner curtain liner and an outer curtain.

In FIGS. 1–5 different views are presented of a preferred embodiment of this invention. Referring to FIG. 1, a standard shower curtain rod 22 is shown attached above a bathtub shower or shower stall by collars 26 at either end of the rod. The shower curtain rod 22 is shown attached to the left side wall. The right wall, to which it is similarly attached, is not shown to simplify the drawing. The curtain rod 22 is shown supporting an outer decorative shower curtain 25, and an inner curtain liner 24 suspended from shower curtain corner supports, generally 50 for the right corner support and 51 for the left corner support, at each end of the curtain rod. Since the shower curtain corner support 51, "corner support" for short, on the left side is the mirror image of that on the right side of the stall looking out, only the corner support 50 on the right side will be described in detail.

Figure 2:
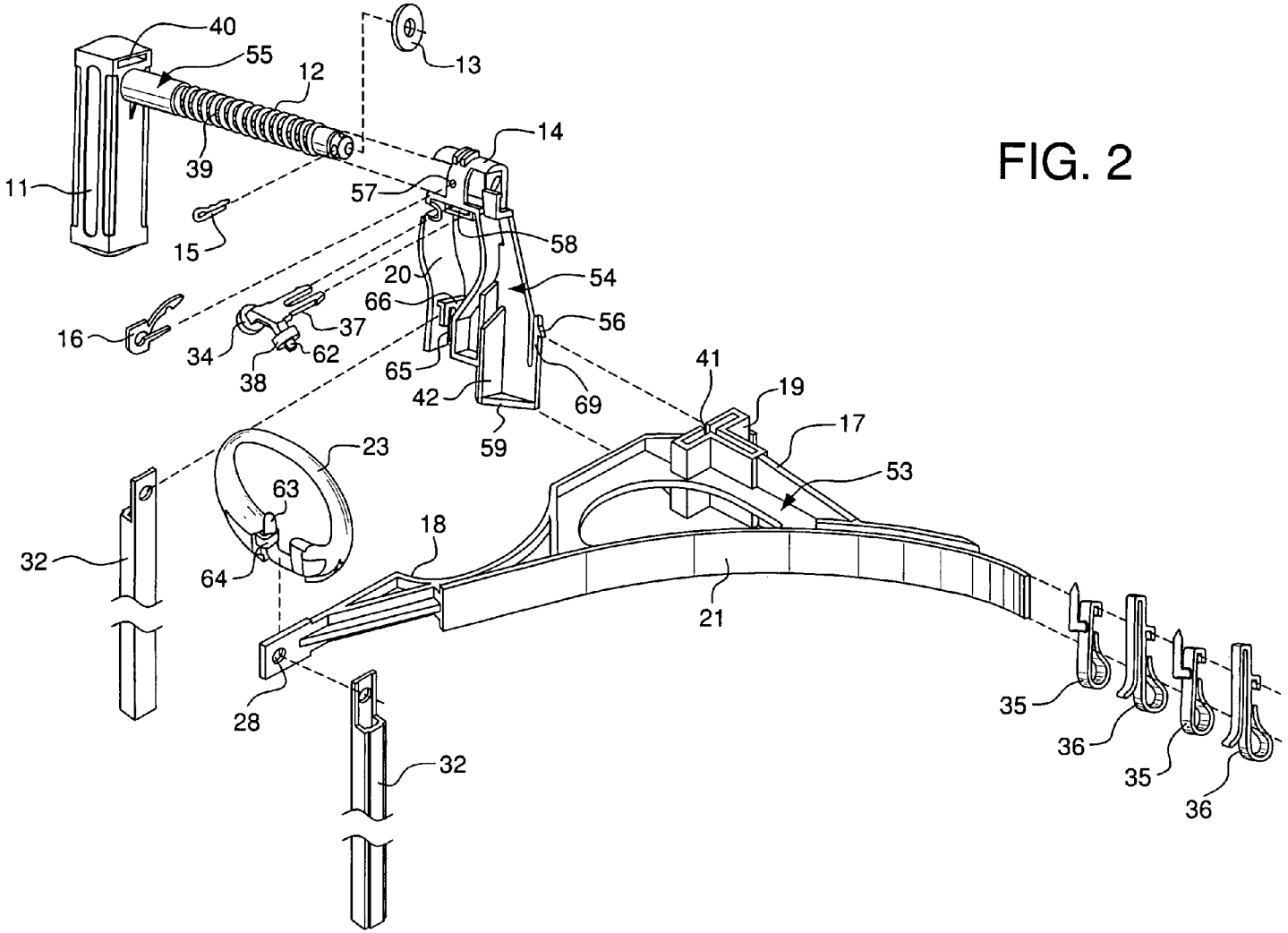
FIG. 2 is an exploded view of the shower curtain corner support showing its constituent parts.
Figure 3:
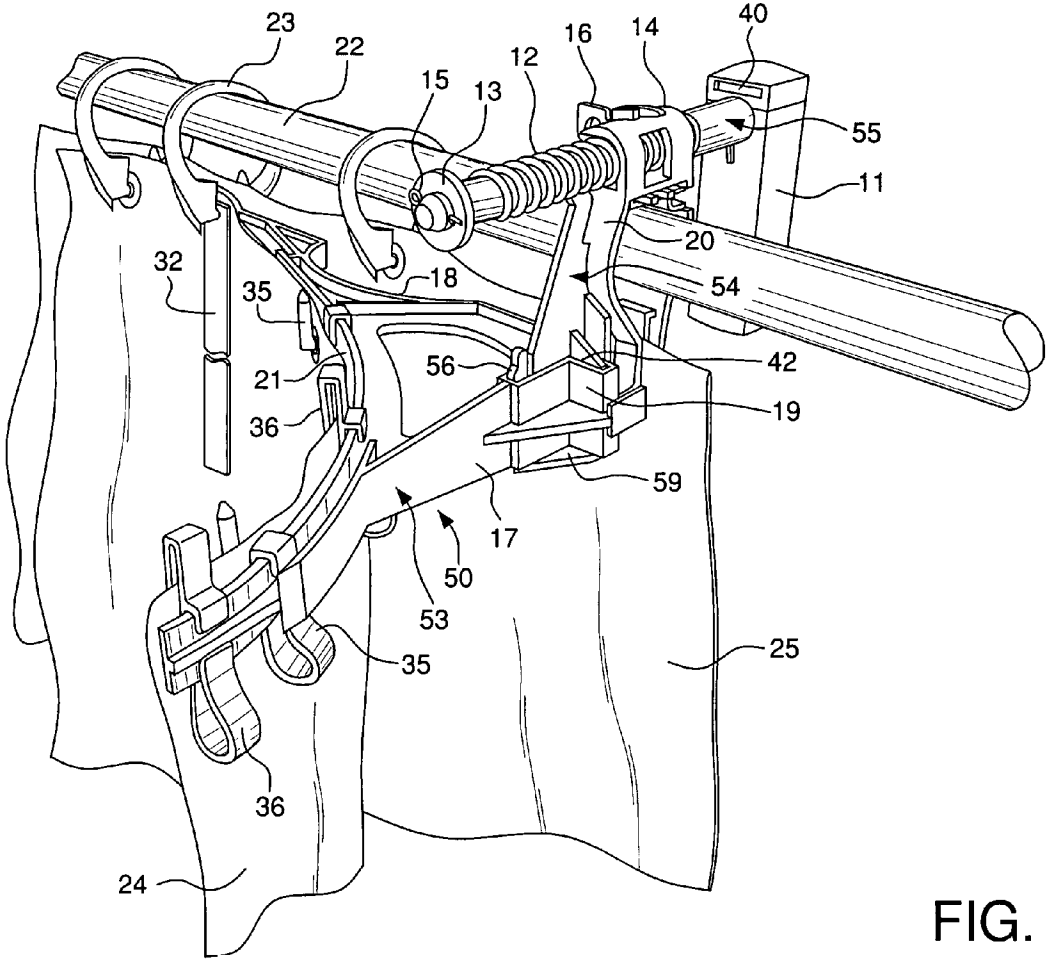
FIG. 3 is an upper perspective view of shower curtain corner support with an inner curtain liner and an outer curtain attached.
Figure 4:
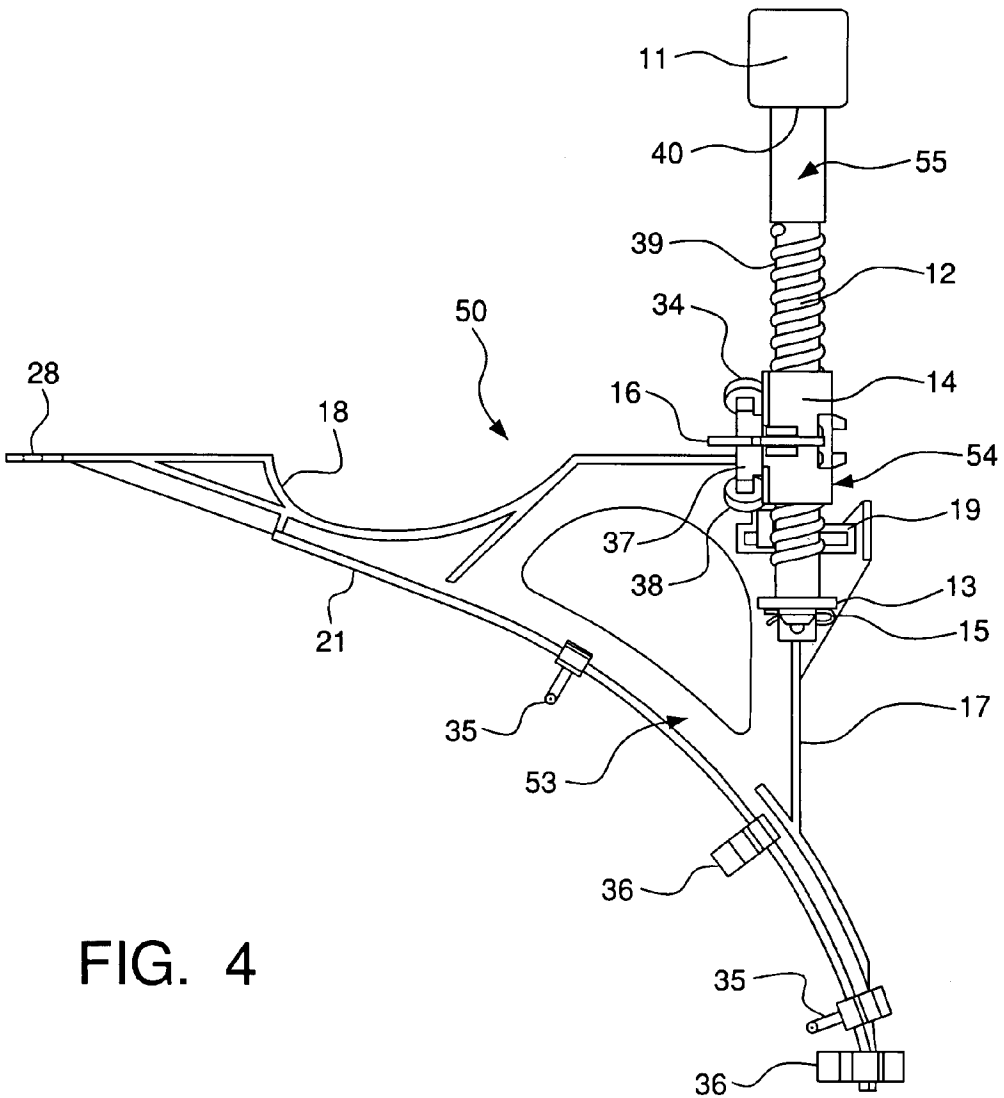
FIG. 4 is a top plan view of the shower curtain support.
Figure 5:
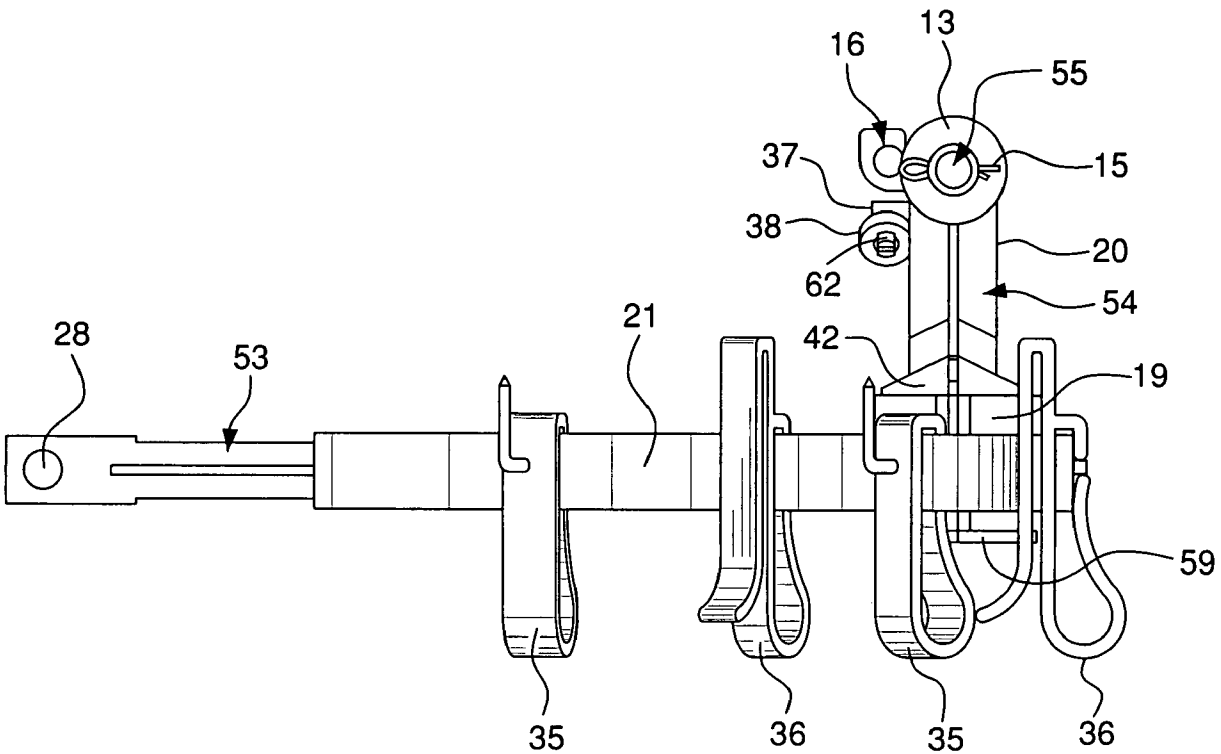
FIG. 5 is a side elevation view of the shower curtain support looking perpendicularly outward across the open side of the bathtub stall.

Referring now to FIGS. 2–5, different views of the corner support 50 are presented showing its main constituent parts and their assembly. Illustrated here is the approximately triangularly shaped corner support frame 53, into which can be inserted upwards, through the open ended T-shaped slot collar 19 on the side 17 of the support frame 53 where it meets the side 18 of this frame, a four ribbed base 42, atop of which is the open cylindrical sleeve 20 and the moment lever support piece 54. This support piece 54 comprises a cylindrical collar 14, projecting across the top surface of the sleeve 20, oriented so that its central cylindrical axis is perpendicular to the central cylindrical axis of the sleeve 20. Into the collar 14 is screwed the cantilevered beam member 55 consisting of the moment lever screw arm 12, to which is attached, at one end, the counterweight container 11. The sleeve 20 is offset forward, toward the outside of the stall at the top of the ribbed base 42, in order to allow the ribbed base 42 to be inserted upward through the open ended T-shaped slot collar 19. This forward offset also allows the cylindrical collar 14 to be located above the shower curtain rod 22. The moment lever screw arm 12 is held in the collar 14 at a fixed distance along the screw by the thread and the clip-pin 16, which is inserted through a hole 57 in the collar 14 and into one of the screw thread holes 39 at the appropriate distance along the screw to provide the proper moment arm length. This moment arm length will be directed perpendicularly outward, across the curtain rod 22, and is determined by the distance along the beam member 55 that is necessary for the counterweight, in the container 11, to balance the support frame 53 and curtain liner, suspended from it, and hold the plane, enclosed by this frame, horizontal and parallel to the floor. On the bottom surface of the collar 14, which forms the top surface of the rod sleeve 20, is a slot 58 into which is inserted, on the side of the collar 14 distal to the near wall of the stall, the wheel axle clip 37. Attached to this wheel axle clip, on two downwardly angled projection arm axles 62, are two freely rotating wheels 34 and 38, oriented by these projection arm axles so that the wheels are axially at right angles to each other on the side of the collar 14, so that they will rotate and ride on either side of the upper surface of the curtain rod 22. The wheels, being distal to the near wall, produce a slight rotational torque which reduces sliding and binding when the corner support 50 is slid along the curtain rod 22. This will facilitate the movement of the corner support 50 on the curtain rod 22, when the corner support is moved back and forth to open and close the stall curtains as shown in FIG. 3. Also shown in FIG. 2, is a liner hook 35 and a liner retainer 36, a curtain ring 23 and a wand 32 to be attached to the corner support 50 to be grasped for moving the corner support 50 back and forth.

Referring again to FIGS. 3, 4 and 5, the essentially triangular support frame 53 has outer edges along its three legs which are the flat strips 17, 18, and 21, vertically oriented, when the plane of this frame is held horizontal to the floor of the stall. These strips are approximately one-eighth of an inch thick and the edge 21 serves as a runner from which can be slidably suspended the liner hooks 35 and liner retainers 36 in order to support, suspended from this edge, a shower curtain liner, as shown in FIGS. 1 and 3. The liner hooks 35 and the liner retainers 36 are shaped to provide a slight pressure contact on edge 21 in order to prevent liner slippage. This edge, which forms the hypotenuse of the triangular support frame 53, is an approximately three-quarters of an inch wide strip formed into a concave, inwardly curved arc and which forms roughly one quadrant of an ellipse. On the corner support 50, the linear distance from the curtain ring hole 28 to the hook 65 is an integral multiple of the attachment interval distance of the outer curtain along the curtain rod 22. When the corner support 50, with a curtain liner 24 attached, is pushed to the lateral wall of the shower stall, the edge 21 will hold the curtain liner approximately tangent to the wall, thus sealing the stall.

Referring again to FIGS. 2, 3 and 4, at the vertex intersection of the edges 18 and 21, of the support frame 53, is a ring hole 28 through which can be passed a curtain ring 23, which will encircle the curtain rod 22, and pass through holes in the wand 32, the curtain liner 24 and the curtain 25, so that all will be held from this curtain ring 23. This curtain ring 23 is moderately flexible and can be opened and closed by manually twisting the ring to latch and unlatch the hook 63 and latch 64.

Several of these curtain rings 23 are also provided to encircle the curtain rod 22 and pass through the regularly spaced curtain holes of a standard shower curtain 25 and shower curtain liner 24 in order to suspend these curtains from the curtain rod as indicated in FIGS. 1 and 3. The edge 18 of the support frame 53 is also indented to accommodate a curtain ring 23 in its regular spacing, see FIGS. 2 and 3.

Referring again to FIGS. 2 and 3, the sleeve 20 and moment lever support piece 54 consists of a four ribbed base 42 shaped to be inserted upward, through the open ended T-shaped slot collar 19, until the base plate 59 of this ribbed base 42 is flush against the bottom of the T-shaped slot collar 19. The inward directed leaf of the ribbed base 42, collinear with the edge 17 of the support frame 53, is partially split vertically to form a flexible, upward directed prong 69 with a clasp 56 at its top. This clasp 56 locks over the top edge of the T-shaped slot collar 19 in order to hold the moment lever support piece 54 in place after it has been inserted through this slot.

Above and forward from the central vertical axis of the ribbed base 42, the moment lever support piece 54 is formed into the curtain rod sleeve 20, fitted around the curtain rod 22. The curtain rod sleeve 20 is provided, at its base, with a hook 65 and latch 66 which can be unlatched to open this sleeve to fit over and around the curtain rod 22. With the curtain sleeve 20 fitted around and onto the curtain rod 22, the hook 65 can be passed through the end hole in the outer curtain 25, if this curtain is present, and a wand 32 is also suspended from the hook 65. The hook 65 and latch 66 are then latched to close the sleeve 20, thus suspending the corner support 50 from the curtain rod 22. This second wand 32 will hang in front of the shower curtain stall, for use from outside of the stall.

Along the upper surface of the sleeve 20 is the cylindrical moment lever collar 14, the axis of which is oriented perpendicularly to the cylindrical axis of the sleeve 20. When the ribbed base 42 of the moment lever support piece 54 is inserted upward through the T-shaped slot 19 and the sleeve 20 is attached coaxially about the curtain rod 22, the axis of the moment lever collar 14 will be directed perpendicularly outward across and above the curtain rod 22 and parallel to the edge 17 of the support frame 53, see FIG. 3.

Through the moment lever collar 14 is screwed the threaded cantilever arm 55, as described above. Suspended from the outward directed end of the arm 55 is the variable weight container 11. The container 11 is a rectangular box provided with a slot 40 through which various weights can be placed or removed from the box 11. The amount of weight used is determined by what is necessary to balance the suspended corner support 50, in order to hold its planar interior in a horizontal relation to the floor of the stall, when the curtain liner is suspended from it. The lever arm 55 can be wound inward or outward for fine balancing adjustment. At the opposite end of the lever arm 55 is a flat circular disk 13 held in place by a metal clip 15. The disk is provided to prevent the lever arm 55 from being inadvertently rotated outward so far that it falls off. The diameter of the disk 13, therefore, must exceed the diameter of the opening of the collar 14.

Thus, when the corner support 50 is completely assembled, suspended from the curtain rod 22, with the curtains attached as in FIGS. 1 and 3, and properly balanced, then the shower stall can be sealed by moving the corner support 50, along the rod 22, to the right wall of the stall. The inward curved edge 21, of the support frame 53, will hold the curtain liner 24 curved inward, tangent to the lateral wall of the shower stall, thus sealing the stall to prevent water spray from escaping the stall, and also providing privacy to a person in the stall.

It should also be noted that the corner support 50 as described here is essentially right-left symmetrical, in the sense that it can be used at either end of the curtain rod simply by turning over the support frame 53 and assembling the left corner support 51 as the mirror image of the right corner support 50 as indicated.

It is anticipated that the major components of this invention, except for the counterweights and a clip, would be molded out of stiff plastic material.

It will be understood by those skilled in the art, that the above description of the present invention is susceptible to various modifications, changes and adaptations without departing from the scope of the invention.

I claim:

1. An improved curtain corner support apparatus for supporting a portion of a curtain, which is vertically suspended across the open side of a stall enclosure, such as a shower stall area, from a curtain rod, which spans this open side, the support apparatus comprising having means for being slidably attached to the curtain rod and means for attaching and extending an end portion of the curtain inward into the stall area and tangentially meeting a lateral side wall of the stall, the support apparatus further comprising an substantially right triangular, rigid frame with one leg of the frame adapted to be held parallel to the lateral side wall of the stall and the other leg of the frame is adapted to be slidably attached to the curtain rod in parallel alignment with this rod and beneath it, the third hypotenuse side of the frame being shaped into a slightly curved arc, concave inward relative to the interior, bounded region of the frame, this arc side having means for attaching a curtain to the frame and suspending the curtain downward from the frame, the support apparatus further comprising a cantilevered, end weighted, beam member having means for attaching to the frame, at variable moment arm lengths, with the weighted end adapted to extend horizontally outward from the stall area and perpendicularly across the curtain rod above the frame leg, which is adapted to be parallel to the lateral wall, this weighted beam member providing a counterbalance in order to hold the frame horizontal, when the curtain is suspended from it, with the arc side of the frame directed into the stall area.

2. The apparatus of claim 1, in which the means for attaching the frame to the curtain rod comprises an open, flexible, cylindrical sleeve which can be clipped around the curtain rod in axial alignment with this rod, this sleeve and frame further having means for attaching the side of this sleeve to the leg of the frame, holding this leg in parallel alignment to the curtain rod and beneath it.

3. The apparatus of claim 1, in which the leg of the frame, parallel to the curtain rod, is of such dimension as to provide means for attaching an outer curtain to this leg while maintaining spacing intervals, between the outer curtain attachment points to this leg, equal to integral multiples of the attachment point intervals of this outer curtain along the curtain rod.

4. The apparatus of claim 1, in which the leg of the frame, parallel to the curtain rod, has an indented segment about the midpoint of this leg, provided to accommodate a curtain hook on the rod to attach to a second, outer curtain, if an outer curtain is present and suspended from the same curtain rod.

5. The apparatus of claim 1, further comprising a downward suspended inner wand which is attached to the leg of the frame which is parallel to the curtain rod at the end of the leg, distal to the near wall of the stall, the wand providing means for gripping the support apparatus from the inside of the stall area in order to slide the support apparatus, with the curtain attached, back and forth along the curtain rod without producing any significant binding torque.

6. The apparatus of claim 1, further comprising an outer wand suspended downward from the open, flexible, cylindrical sleeve, this wand providing means for gripping the support apparatus, from outside the stall area, in order to slide the support apparatus back and forth along the curtain rod without producing any significant binding torque.

7. The apparatus of claim 1, in which the cantilevered, end weighted, beam member has means for varying the moment weight amount.

8. The apparatus of claim 1, in which the means for attaching and suspending the curtain from the triangular frame are hooks and retaining clips slidably attached to the arc side of the frame.

9. The apparatus claim 1, further comprising two downward angled projection arm axles, oriented at 90 degrees to each other, attached to the upper surface of the open, flexible, cylindrical sleeve, distal to the near wall of the stall, to each of these axles is attached a freely rotating wheel, these wheels are oriented by their respective projection arm axles so that these wheels are axially at right angles to each other and will rotate and ride on either side of the upper surface of the curtain rod, to facilitate the movement of the support apparatus on the curtain rod, when the support apparatus is moved back and forth to open and close the stall curtains.

* * * * *